United States Patent [19]

Harmsen et al.

[11] 4,138,604

[45] Feb. 6, 1979

[54] ELECTRICAL PLUG-TYPE CONNECTOR

[75] Inventors: Nils Harmsen; Horst Markhof, both of Bruchköbel; Walter Reichelt, Hanau; Klaus-Ludwig Schiff; Horst Thiede, both of Bruchköbel, all of Fed. Rep. of Germany

[73] Assignee: W. C. Heraeus GmbH, Hanau am Main, Fed. Rep. of Germany

[21] Appl. No.: 705,919

[22] Filed: Jul. 16, 1976

[30] Foreign Application Priority Data

Sep. 13, 1975 [DE] Fed. Rep. of Germany ..... 2540943

[51] Int. Cl.[2] ..... H01H 1/02

[52] U.S. Cl. ..... 200/267; 200/270; 339/278 C; 428/929; 200/268

[58] Field of Search ..... 200/262, 267, 268, 270; 339/278 C; 29/182

[56] References Cited

U.S. PATENT DOCUMENTS

| | | | |
|---|---|---|---|
| 3,648,355 | 3/1972 | Shida et al. | 339/278 C |
| 3,671,702 | 6/1972 | Penczek | 200/268 |
| 3,711,383 | 1/1973 | Schiekel et al. | 200/268 |
| 3,927,841 | 12/1975 | Iacobucci | 339/278 C |

FOREIGN PATENT DOCUMENTS

| | | | |
|---|---|---|---|
| 563263 | 9/1958 | Canada | 200/262 |
| 47-40509 | 10/1972 | Japan | 339/278 C |
| 1177905 | 1/1970 | United Kingdom | 339/278 C |

*Primary Examiner*—Benjamin R. Padgett
*Assistant Examiner*—J. L. Barr
*Attorney, Agent, or Firm*—Flynn & Frishauf

[57] ABSTRACT

To provide low contact resistance, long life, and resistance against tarnishing under corrosive, particularly sulfur atmospheres, a substrate carrier has a layer of palladium applied thereto, of a thickness between 0.5 and 5 μm, preferably between 1 and 3 μm, to which a coating of gold is applied which is porous and has a thickness of only between 0.05 μm and 0.1 μm; the porous gold coating forms islands of gold on the palladium which, in use and as the terminal is wiped against a counter element, smears over the palladium, thus effectively covering the palladium, preventing tarnishing, and maintaining low contact resistance throughout the useful life of the terminal element.

7 Claims, 1 Drawing Figure

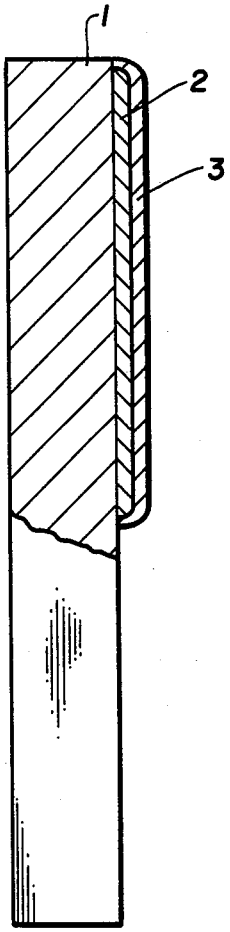
1
2
3

ELECTRICAL PLUG-TYPE CONNECTOR

CROSS REFERENCE TO RELATED APPLICATIONS U.S. Ser. No. 705,918, filed July 16, 1976 (claiming priority of German Application P 25 40 956.7-34 of Sept. 13, 1975); and U.S. Ser. No. 705,917, filed July 16, 1976 (claiming priority of German Application P 25 36 985.1-34 of Aug. 20, 1975), all assigned to the assignee of the present application.

The present invention relates to an electrical plug-type connector having a contact surface which is gold coated. The contact resistance of electrical plug-type connectors used in electronics and data processing equipment must be as low as possible throughout its useful life, and retain its low contact resistance without change. Low contact resistance means that the contacts should, simultaneously, have high conductivity. Metals which have especially high electrical conductivity such as silver, copper, gold, aluminum, cannot all be used, and have different characteristics. Copper and aluminum are not suitable because their surfaces readily form oxide films or skins, or are subject to other corrosion layers. As a result, the contact resistance of a non-permanent terminal changes by several orders of magnitude. Gold can be used for plug-type connectors practically without any limitation, but its price is high. Silver cannot be used in some atmospheres, particularly in highly reactive atmospheres which also include sulfur; silver sulfide layers form at the surface which are insulating and interfere with good electrical contact. Because of the formation of surface layers on practically all metals, except gold, gilded contact layers were used for electrical terminals in large quantity, by applying a gold skin or thin coating which is applied directly or indirectly on a substrate or carrier forming the body of the terminal.

Gold is much more expensive than silver — several times as much — and it has therefore frequently been tried to coat silver with gold so that silver will be more resistant to tarnishing and corrosion in the presence of sulfur or hydrogen sulfide. Gold is, however, subject to deterioration when in contact with silver sulfide so that the coating of the gold required a thickness of from 2 to 3 $\mu$ m. It has been believed that thin porous coatings of gold on a silver surface do not provide sufficient protection against tarnishing; see, for example, "Reid & Goldie": "Gold Plating Technology", 1974, page 492.

It is an object of the present invention to provide an electrical terminal or connector, and particularly a plugtype connector terminal for use in electronics and data processing which provides a uniform, low contact resistance without use of massive gold or thicker gold layers, which retains the good contact characteristics of gold without, however, using much of this precious metal. The chemical resistance and particularly resistance against attack in corrosive and sulfur-containing atmospheres should be good.

SUBJECT MATTER OF THE PRESENT INVENTION

Briefly, the electrical terminal has a gilded contact layer; the gilded contact layer comprises metallic palladium which is coated with a thin, porous surface layer of gold having a thickness of between 0.05 $\mu$ m and 0.1 $\mu$ m; said palladium preferably being between about 1 and 3 $\mu$ m.

The invention will be described by way of example with reference to the accompanying drawings, wherein the single FIGURE is a schematic cross-sectional view through a contact blade.

A support or substrate for a projecting terminal prong 1, for example of brass, bronze, or other suitable carrier material, is coated with a thin layer 2 of palladium in the region or zone where contact is to be made; an extremely thin, porous layer 3 of gold is applied thereto.

The terminal has surprisingly excellent electrical characteristics; it is believed that this is due to the discontinuous porous gold layer which results in low contact resistance when the terminal is new. In use, and as the terminal is wiped against a counter element, the islands of gold are smeared over the entire surface of the contact terminal to effect a continuous gold layer which is thinner than the original one, but more uniform. Experiments have shown that, surprisingly, the contact resistance as measured does not deviate essentially from solid gold contacts, or from contacts which have a substantially thicker and continuous solid layer of gold at the contact surface. Even if the contact pressure is low, the contact resistance does not rise substantially. The distribution of the gold from the islands of gold over the entire surface of the contact appears to occur even after a few connecting and disconnecting movements. Thus, the terminal is well protected against tarnishing or other corrosion.

The present invention is specifically directed to terminal elements which are in mass production so that the cost of making an individual terminal should be as low as possible. The terminals are highly resistant against chemical attacks, particularly when used in corrosive atmospheres or in atmospheres containing sulfur.

The terminal layer may entirely surround the contact carrier, or may be applied only to that portion or side which actually engages a counter terminal. The thickness of the palladium layer 2 is between 0.5 and 5 $\mu$ m, preferably between 1 and 3 $\mu$ m; the thickness of the gold layer, which is porous, is thinner by about an order of magnitude, and between 0.05 to 0.1 $\mu$ m.

The palladium layer can be applied to the substrate carrier by a suitable mechanical process, for example by rolling on a thin sheet, by a roll bonding process, by vapor deposition sputtering, or by galvanic deposition. The gold layer is then applied on the palladium layer, for example by galvanic deposition or vacuum deposition, such as evaporation or sputtering, or by ion implantation. The porous surface of gold may be hard gold.

We claim:

1. Electrical plug-type terminal connector contact element adapted to be wiped against a counter element comprising a metal electrical plug-type termainal connector substrate and a gold surfaced contact layer in direct contact with and covering at least a portion of said metal plug-type terminal connector substrate, said contact layer consisting essentially of (i) a layer of palladium between about 0.5 and 5 $\mu$ m thick which is coated with (ii) a thin and a porous surface coating of hard gold having a thickness of between 0.05 $\mu$ m and 0.1 $\mu$ m.

2. Contact element according to claim 1, wherein the contact layer and the gold layer completely surround the carrier.

3. Contact element according to claim 1, wherein said substrate is a copper-base alloy.

4. Contact element according to claim 3, wherein the palladium layer has a thickness of between 1 and 3 $\mu$ m.

5. Contact element according to claim 1, wherein the palladium layer is a layer applied by rolling on, roll bonding, vapor deposition sputtering or galvanic deposition.

6. Contact element according to claim 1, wherein the gold coating comprises a coating applied by galvanic deposition, vacuum deposition including at least one of: evaporation; sputtering; or by ion implantation.

7. Contact element according to claim 4 wherein said substrate is brass or bronze.

* * * * *